US007243468B2

(12) United States Patent
Wright

(10) Patent No.: US 7,243,468 B2
(45) Date of Patent: Jul. 17, 2007

(54) SYSTEM TO LAY OUT THE POSITION OF GLASS BLOCKS FOR CONSTRUCTION OF A GLASS BLOCK WALL

(75) Inventor: Brian Wright, Snohomish, WA (US)

(73) Assignee: Seattle Glass Block, Woodinville, WA (US)

( * ) Notice: Subject to any disclaimer, the term of this patent is extended or adjusted under 35 U.S.C. 154(b) by 0 days.

(21) Appl. No.: 10/411,040

(22) Filed: Apr. 10, 2003

(65) Prior Publication Data

US 2004/0200163 A1 Oct. 14, 2004

(51) Int. Cl.
*E04C 1/42* (2006.01)
*E04B 2/02* (2006.01)

(52) U.S. Cl. ..... 52/306; 52/293.1; 52/582.1; 52/604

(58) Field of Classification Search ..... 52/306, 52/307, 308, 586.1, 586.2, 582.1, 604, 415, 52/293.1, 270, 245, 249, 561
See application file for complete search history.

(56) References Cited

U.S. PATENT DOCUMENTS 2,228,363 A * 1/1941 Pinney ..... 52/580
2,235,356 A * 3/1941 Byers ..... 52/582.1
2,247,836 A * 7/1941 Goldbeck ..... 52/270
4,169,688 A * 10/1979 Toshio ..... 404/40
4,496,263 A * 1/1985 Laarhoven ..... 403/402
4,761,922 A * 8/1988 Black ..... 52/71
4,986,048 A * 1/1991 McMarlin ..... 52/306
5,003,746 A * 4/1991 Wilston ..... 52/592.1
5,010,704 A * 4/1991 Thompson ..... 52/308
5,193,320 A * 3/1993 Coccagna ..... 52/442
5,430,985 A * 7/1995 Coleman ..... 52/308
5,640,818 A * 6/1997 Wirkus et al. ..... 52/306
5,651,220 A * 7/1997 dit Felix ..... 52/81.5
5,655,345 A * 8/1997 Thompson ..... 52/396.1
5,704,177 A * 1/1998 Wirkus et al. ..... 52/308
5,740,646 A * 4/1998 Wirkus et al. ..... 52/308
5,921,021 A * 7/1999 Coates ..... 47/33
6,000,181 A * 12/1999 Wheeler ..... 52/241
6,000,186 A * 12/1999 Fielding et al. ..... 52/564

(Continued)

FOREIGN PATENT DOCUMENTS

DE 33 09 463 A1 * 9/1984
EP 0 166 219 A1 * 1/1986

(Continued)

OTHER PUBLICATIONS

Bob Pennycook, Building With Glass Blocks, Doubleday Canada Ltd., Toronto, Ontario, 1987, p. 16.

*Primary Examiner*—Robert Canfield
(74) *Attorney, Agent, or Firm*—John M. Johnson; Carter Ledyard & Milburn LLP

(57) ABSTRACT

The present application discloses curb components that represent various shapes of glass blocks to be used in the construction of a curb for a glass block wall, along with a system and method for laying out the curb components. The curb components can be fitted together to lay out the positioning of glass blocks, such that a user can lay out potential designs for glass block walls prior to constructing the glass block wall. Connection mechanisms are used, which enable a variety of joint sizes, as well as angled joints to be formed.

9 Claims, 7 Drawing Sheets

U.S. PATENT DOCUMENTS 6,212,844 B1 * 4/2001 Lange ..... 52/563
6,453,632 B1 * 9/2002 Huang ..... 52/403.1
6,655,100 B1 * 12/2003 Andino ..... 52/247
6,763,643 B1 * 7/2004 Mårtensson ..... 522/586.1
6,823,634 B2 * 11/2004 Wright ..... 52/306
6,922,961 B2 * 8/2005 Wright ..... 52/308
6,944,998 B1 * 9/2005 King ..... 52/314
2004/0074179 A1 * 4/2004 Wright ..... 52/308

* cited by examiner

SYSTEM TO LAY OUT THE POSITION OF GLASS BLOCKS FOR CONSTRUCTION OF A GLASS BLOCK WALL

FIELD

The present invention relates to a system for constructing a curb for a glass block wall. In particular, the present invention can be used to accurately lay out the position of glass blocks, as well as to assist in the design of potential glass block walls.

BACKGROUND OF THE INVENTION

Glass blocks are widely used in modern architecture and in the construction industry for building structures such as walls, partitions and shower walls. In addition to the regular rectangular shape, glass blocks can have various shapes including 90-degree, 45-degree, and radius (i.e. curved). The various shapes of glass blocks allow for a glass block wall to have hundreds of potential configurations. Glass blocks commonly have peripheral flanges extending outwardly from each side on the front and back surfaces.

The curb of a glass block wall may be defined as the template or base for the first horizontal row of glass blocks. As glass blocks cannot be cut to fit a particular design and very little adjustment to the joint can be made once construction of the glass block wall has begun, it is essential to correctly lay out the curb. However, it is often difficult for an unskilled laborer to accurately lay out the design of a glass block wall such that the joint size is even and the angles between the blocks are correct.

As a consequence, there is a need for a system, which enables various designs for a glass block wall to be easily laid out. Accordingly, it is an object of the invention to provide a system of curb components, which can be used to accurately lay out positions of glass blocks and can be a template for construction.

SUMMARY OF THE INVENTION

The present invention provides a system to lay out the position of glass blocks for construction of a glass block wall, comprising a plurality of curb components shaped to represent a floor contacting surface of the glass blocks. Adjacent curb components may be connected to each other using a variety of connecting mechanisms including: connection clips, a ridge and depression system, a sliding socket, or a receptacle and projection system. The curb components are used to lay out the position of the glass blocks, while the connection mechanism is used to lay out the spacing between adjacent glass blocks.

The curb components may be used to lay out a straight glass block, a 90-degree glass block, a 45-degree glass block, or a radius glass block.

The connection clips may be shaped like a staple and may lay out a ⅛", ¼", ⅜", or ⅝" spacing between adjacent glass blocks, as well as allow for the construction of a curved glass block wall design.

The system may be used to outline a design for a glass block wall by first using the curb components and connecting adjacent curb components with one of the described connecting mechanisms. The curb components may then be secured to the floor. Glass blocks are then placed over the curb components.

BRIEF DESCRIPTION OF THE DRAWINGS

Further features and advantages of the invention will be apparent from the following detailed description, given by way of example, of a preferred embodiment taken in conjunction with the accompanying drawings, wherein.

DETAILED DESCRIPTION OF THE INVENTION

Figure 1:
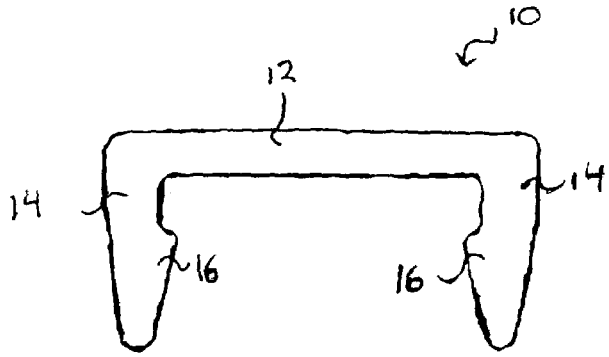
FIG. 1 is a top view of a connection clip.

Referring to FIGS. 1–6, a first embodiment of the curb system is shown. Referring to FIG. 1, a top view of a connection clip 10 is shown. The connection clip 10 is shaped like a staple having a back 12 with two posts 14 extending in the same direction transversely to the back 12 at each end of back 12. The posts 14 each have a bump 16 that protrudes such that the bumps 16 face each other. The back 12 of the connection clip 10 may come in various lengths including, ⅛", ¼", ⅜", and ⅝".

Figure 2:
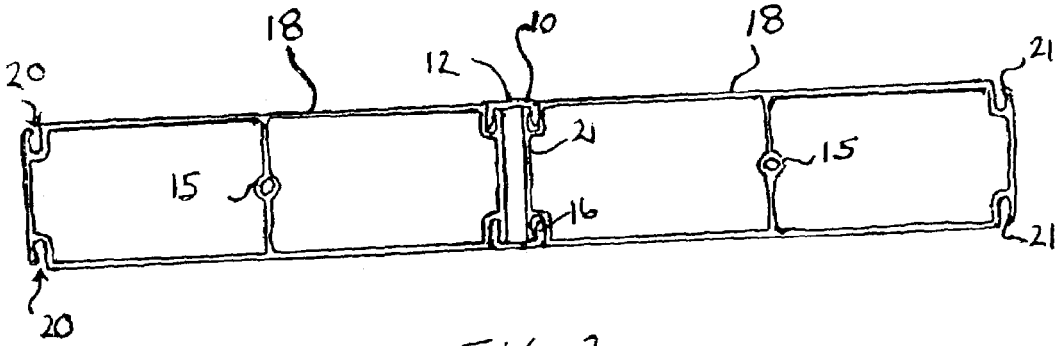
FIG. 2 is a top view of two straight block curb components connected by two connection clips.

Referring to FIG. 2, a top view of two straight block curb components 18 connected by connection clips 10 is shown. The straight block curb components 18 are connected to the connection clips 10 by a receptacle 20 located at each corner of the straight block curb components 18. Receptacle 20 has a receptacle bump 21, which allows the bump 16 (see FIG. 1) of the connection clip 10 to snap together with the receptacle bump 21.

The straight block curb components 18 are used for supporting a regular glass block, and may come in various lengths including 4", 6" and 8".

Figure 3:
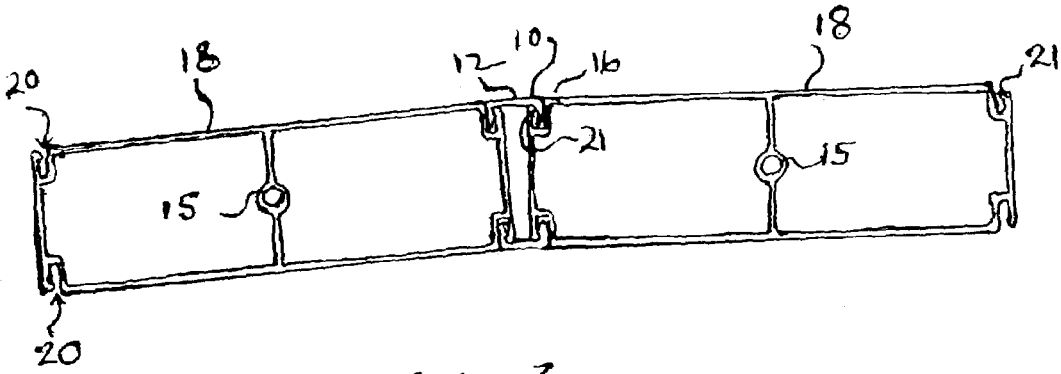
FIG. 3 is a top view of two straight block curb components connected by variable sized connection clips to enable the construction of a curved wall.

Referring to FIG. 3, a top view of two straight block curb components 18 with connection clips 10 with differing lengths of back 12 is shown. The use of connection clip 10 with a back 12 on one side of a joint that is longer than the back 12 on a connection clip 10 on the opposite side allows for the layout of a curved wall.

Figure 4:
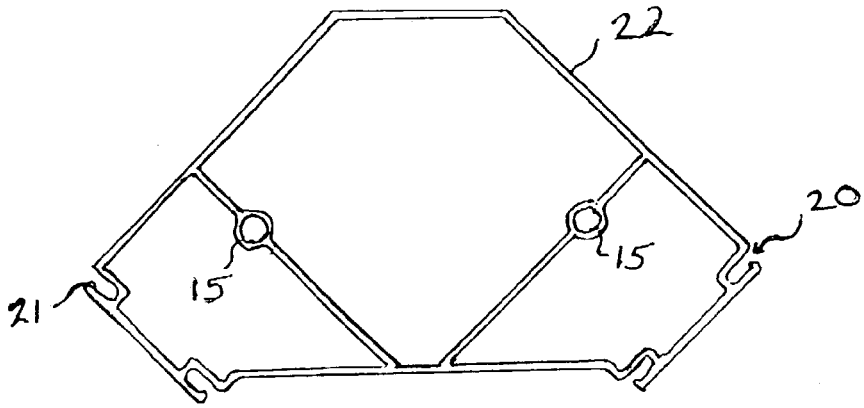
FIG. 4 is a top view of a 90-degree curb component for supporting a 90-degree glass block.
Figure 5:
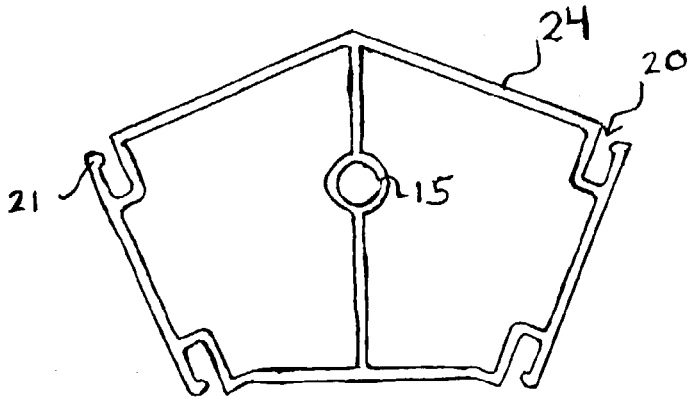
FIG. 5 is a top view of a 45-degree curb component for supporting a 45-degree glass block.
Figure 6:
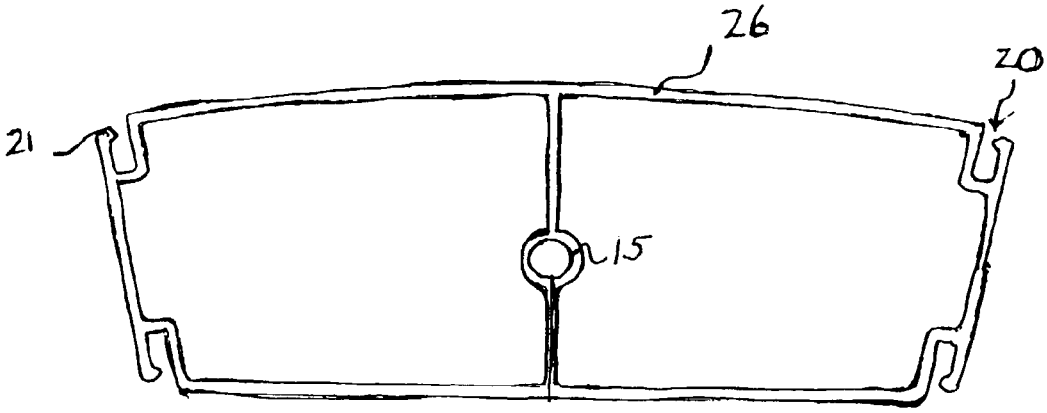
FIG. 6 is a top view of a radius curb component for supporting a radius glass block.

The curb components may come in various shapes corresponding to different shapes of glass blocks. Referring to FIG. 4, a top view of a 90-degree curb component 22 corresponding to a 90-degree glass block is shown. Referring to FIG. 5, a top view of a 45-degree curb component 24 corresponding to a 45-degree glass block is shown. Referring to FIG. 6, a top view of a radius curb component 26 corresponding to a radius block is shown. As shown in FIGS. 4–6 each of the curb components 22, 24, and 26 have receptacles 20 located at each corner of the respective curb component, with receptacle bumps 21 to engage the bump 16 of connection clip 10 as shown with the straight block curb components 18 in FIGS. 2–3. The connection clip 10 enables the curb components 18, 22, 24 and 26 to be snapped together such that the spacing between the glass blocks is established by the width of the connection clips 10. Although, the connection clips 10 are described as snapping into the receptacles 20 of the curb components, other methods of fitting the connection clips with the curb components may be used. Further, although a receptacle 20 is located at each corner of the curb components 18, 22, 24 and 26, more or less than four receptacles 20, as well as other locations for the receptacles 20, may be used.

Figure 7:
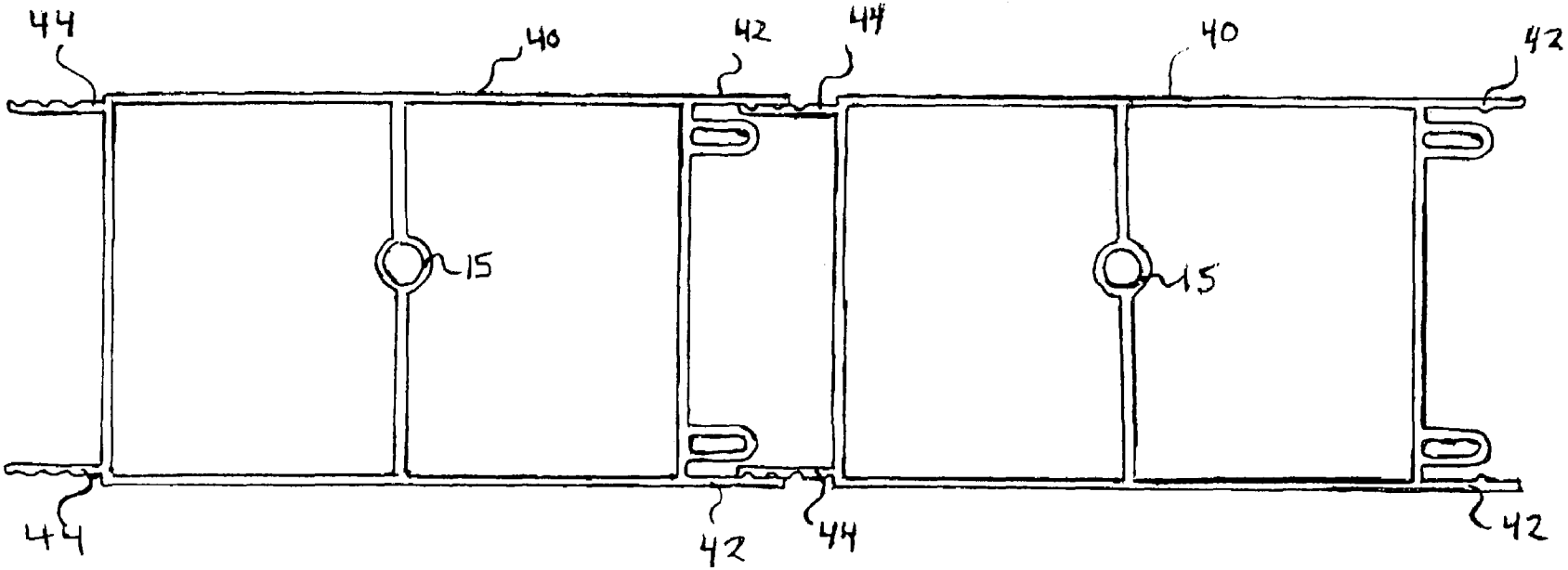
FIG. 7 is a top view of a two straight block curb components connected using ridges and depressions.
Figure 8:
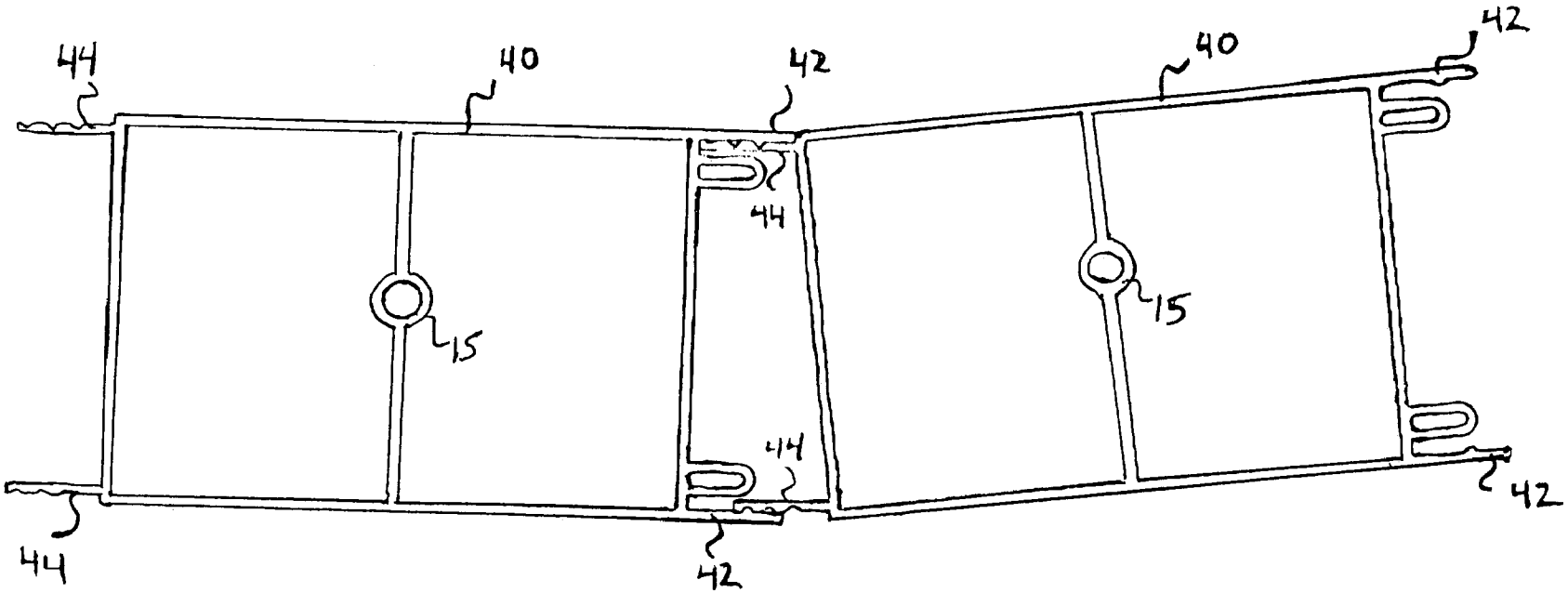
FIG. 8 is a top view of two straight block curb components connected to form a curved joint using ridges and depressions.

Referring to FIG. 7, a top view of two straight block curb components 40 connected using a joint formed from ridges and depressions is shown. More specifically, each straight block curb component 40 has a horizontal tab containing depressions 44 extending from each corner on one side, and horizontal tabs containing ridges 42 extending from each corner on another side. The ridges 42 of a first curb component connect with the depressions 44 of an adjacent curb component to provide joints with fixed variations of adjustable width. Referring to FIG. 8, an angled or curved joint may be formed by connecting the ridges 42 and depressions 44 closer together on one side of the joint than the opposite side of the joint.

Although three depressions are illustrated in FIGS. 7 and 8, any number of depressions may be used to provide any number of variable widths.

Figure 9:
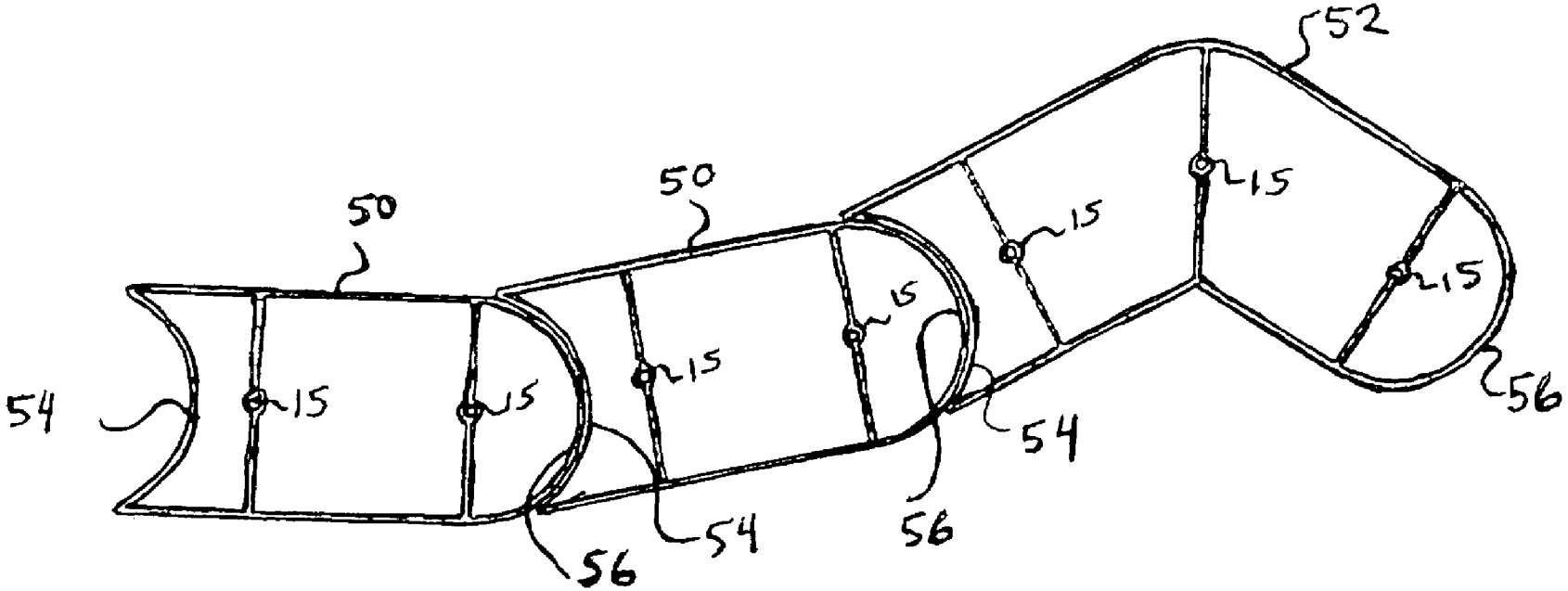
FIG. 9 is a top view of a two straight curb components and a 90-degree curb component connected using a sliding socket.

Referring to FIG. 9, a top view of two straight curb components 50 and a 90-degree curb component 52 is shown. Each curb component has a concave edge 54 and a convex edge 56. The concave edge 54 of one curb components fits along the convex edge 56 of another curb component to form a sliding socket. The joint may be adjusted to form various angles by positioning the concave edge 54 relative to the convex edge 56.

Figure 10:
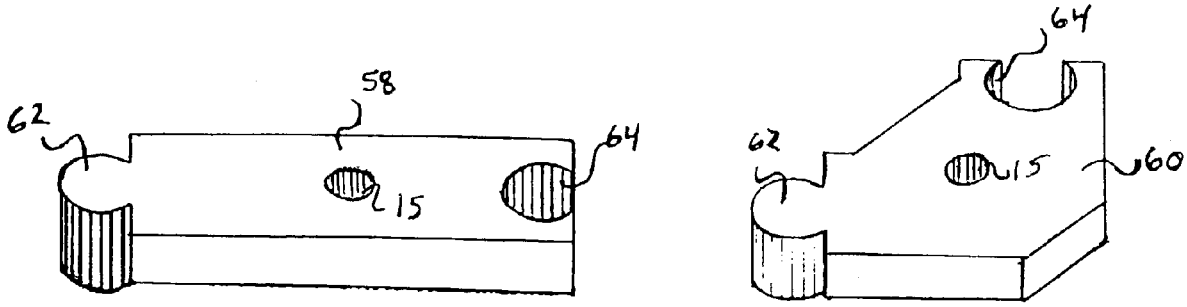
FIG. 10 is a perspective view of a straight curb component and a 90-degree curb component having a projection and receptacle for coupling.

Referring to FIG. 10 a perspective view of a straight block curb component 58 and a 90-degree curb component 60 is shown. In this embodiment each curb component includes a projection 62 on one side and a receptacle 64 on the other side. The projection 62 of one curb component fits together with the receptacle 64 of another curb component to form a fitted socket.

Advantageously, the curb components 18, 22, 24, 26, 40, 50, 52, 58 and 60 described in FIGS. 2–10 may be used to mirror the glass blocks that they represent such that a user may easily experiment with various designs for a potential glass block wall.

Referring to FIGS. 2–10, in order to assemble the glass block wall, the curb components may be secured to the floor. Mounting slots 15 may be found on the curb components 18, 22, 24, 26, 40, 50, 52, 58 and 60, which allow for a screw to attach the respective curb component to the floor.

Figure 11:
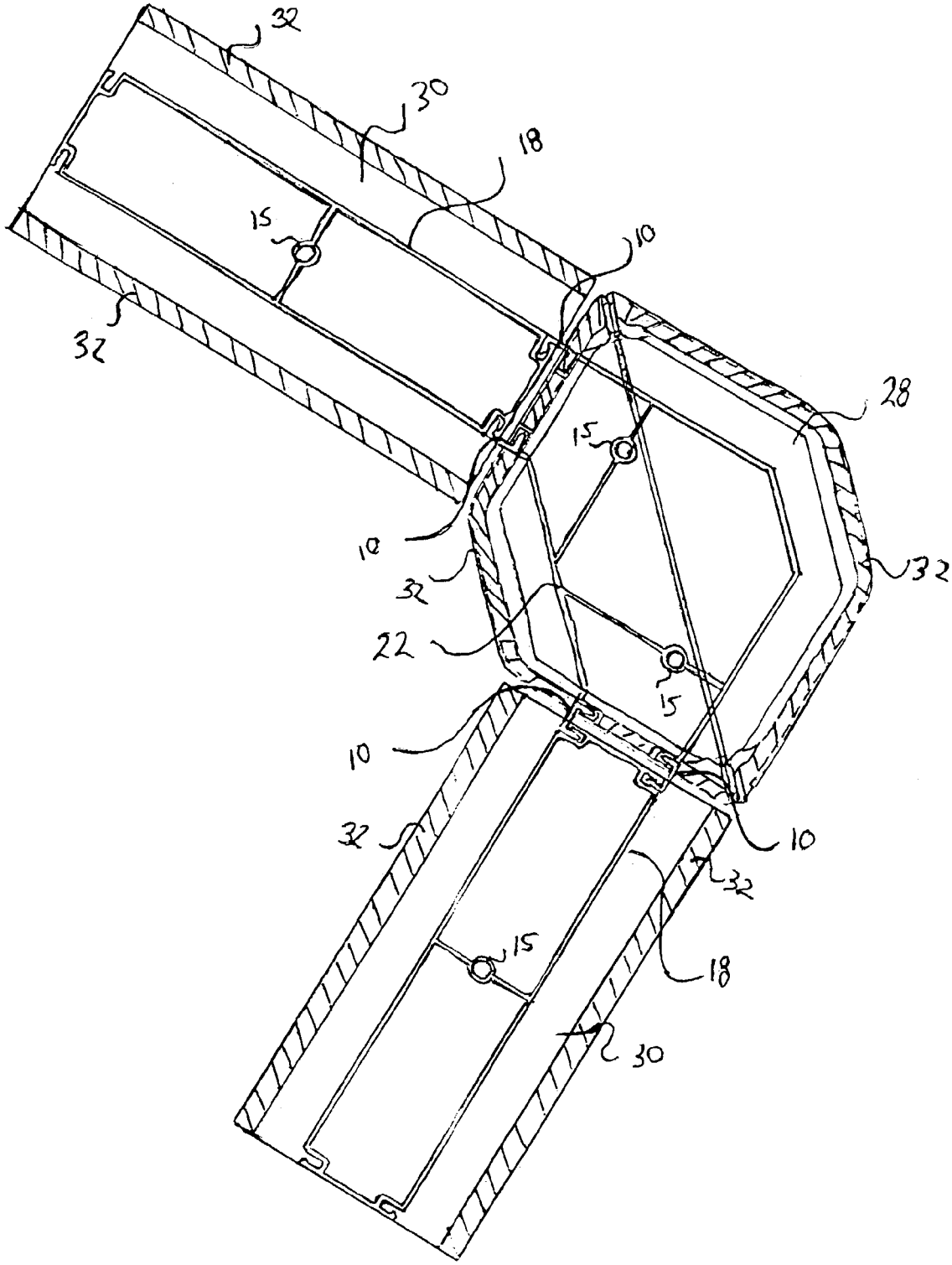
FIG. 11 is a top view of a 90-degree curb component connected to two straight curb components.

FIG. 11 shows a top view of a 90-degree curb component 22 connected to two straight curb components 18 with connection clips 10. After the curb components 18 and 22 and connection clips 10 have been snapped together, they may be fastened to the floor using screws in mounting slots 15. The glass block wall may then be constructed on top of the curb components 18 and 22. The peripheral flange 32 of the 90-degree glass block 28 fits over the 90-degree curb component 22, while the peripheral flanges 32 of the regular, rectangular glass blocks 30 fit over the straight curb components 18.

As seen in FIG. 11, the curb components 18, 22, 24, 26, 40, 50, 52, 58 and 60 can be designed to fit within the raised peripheral flange 32 formed around the face of the respective glass blocks, such that when the representative glass block is positioned upon the curb component, the curb component is hidden from sight. Alternatively, the curb components 18, 22, 24, 26, 40, 50, 52, 58 and 60 can be designed to fit flush with the peripheral flange of the respective glass block or to protrude.

Various designs of glass block walls can be laid out by positioning various shapes of curb components, and by using the connection mechanisms. The curb components can be used in the construction of a glass block wall for showers, partitions, or other applications.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to the description. It is therefore contemplated that the appended claims will cover any such modifications or embodiments as fall within the true scope of the invention.

What is claimed is:

1. A system to lay out a pattern for positioning and supporting glass blocks in the construction of a glass block wall, comprising: a plurality of curb components, each curb component having a floor contacting surface and a top surface which supports and conforms to a bottom of a corresponding one of said glass blocks, adjacent ones of said plurality of curb components being removeably couplable at their ends to each other and adjustable to adjust an angle between adjacent curb components, and wherein each of said curb components includes a mounting slot operative to receive a fastening mechanism to attach said curb components to a floor.

2. The system according to claim 1, wherein at least one of said plurality of curb components is straight.

3. The system according to claim 1, wherein at least one of said plurality of curb components fits one of a 90-degree glass block, a 45-degree glass block, and a radius glass block.

4. The system according to claim 1, wherein said curb components include a first pair of spaced apart tabs having ridges on one of their outwardly and inwardly facing sides and a second pair of spaced apart tabs having depressions on a side opposite said one sides, said ridges on a first curb component engaging said depressions of a second curb component.

5. The system according to claim 1, wherein said curb components include a convex end on a first end and a concave end at another end, wherein said convex end on a first curb component slidably mates with said concave end on a second curb component.

6. The system according to claim 1, wherein said curb components include a coupling receptacle on a first end and a projection at another end, wherein said coupling receptacle of a first curb component is couplable to said projection of a second curb component.

7. The system according to claim 1, wherein said plurality of curb components are coupled to one another using a plurality of connection clips.

8. The system according to claim 7, wherein at least one of said plurality of connection clips is shaped like a staple.

9. The system according to claim 7, wherein said plurality of connection clips have sizes that allow the construction of a curved glass block wall.

* * * * *